US010480155B2

(12) United States Patent
Davis

(10) Patent No.: US 10,480,155 B2
(45) Date of Patent: Nov. 19, 2019

(54) EXCAVATOR IMPLEMENT TEETH GRADING OFFSET DETERMINATION

(71) Applicant: Caterpillar Trimble Control Technologies LLC, Dayton, OH (US)

(72) Inventor: Kyle Davis, Dayton, OH (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 143 days.

(21) Appl. No.: 15/846,919

(22) Filed: Dec. 19, 2017

(65) Prior Publication Data

US 2019/0186102 A1 Jun. 20, 2019

(51) Int. Cl.
*E02F 3/84* (2006.01)
*E02F 3/76* (2006.01)
(Continued)

(52) U.S. Cl.
CPC ..... *E02F 3/844* (2013.01); *E02F 3/435* (2013.01); *E02F 3/769* (2013.01); *E02F 9/264* (2013.01)

(58) Field of Classification Search
CPC . E02F 3/844; E02F 3/435; E02F 3/769; E02F 3/431; E02F 9/264
See application file for complete search history.

(56) References Cited

U.S. PATENT DOCUMENTS 2,042,196 A 5/1936 Senz
2,993,285 A 7/1961 Hoxie
(Continued)

FOREIGN PATENT DOCUMENTS

CN 204343353 U 5/2015
CN 205242469 U 5/2016
(Continued)

OTHER PUBLICATIONS

Ihm, Retractable "Feeder Teeth" for Loader Bucke for Loader Buckets, 1999, vol. 23, Iss. 5, Accessed: https://www.farmshow.com/a_article/php?aid=13072.
(Continued)

*Primary Examiner* — Aaron L Troost
(74) *Attorney, Agent, or Firm* — Dinsmore & Shohl LLP

(57) ABSTRACT

An excavator comprises a machine chassis, boom, stick, and implement. The boom, stick, and implement collectively define a variable implement angle $\theta_{Bucket}(t)$ indicative of a current position of the implement relative to horizontal as a function of time t. The implement comprises teeth extending a tooth height h from an internal leading edge $J_I$ to an external leading edge $J_E$. The teeth are spaced along $J_I$ and define an active raking ratio r. Controllers are programmed to execute an implement teeth grading offset determination process that comprises determining a variable implement offset angle $\theta_{Delta}(t)$ at least partially based on a difference between an original target design angle $\theta_{Tgt}(t)$ and the variable implement angle $\theta_{Bucket}(t)$, determining an implement offset IO based on h, r, and $\theta_{Delta}(t)$, and determining a new target design elevation $Elv_{Tgt,New}(t)$ based on IO and an original target design elevation $Elv_{Tgt,Orig}(t)$.

20 Claims, 6 Drawing Sheets

(51) Int. Cl.
*E02F 3/43* (2006.01)
*E02F 9/26* (2006.01)

(56) References Cited

U.S. PATENT DOCUMENTS

| | | | |
|---|---|---|---|
| 3,550,960 | A | 12/1970 | Holder |
| 3,795,070 | A | 3/1974 | Bronson et al. |
| 4,288,196 | A | 9/1981 | Sutton, II |
| 4,967,850 | A | 11/1990 | Bargfrede et al. |
| 5,027,535 | A | 7/1991 | Maguina-Larco |
| 7,293,376 | B2 | 11/2007 | Glover |
| 7,627,966 | B2 | 12/2009 | Koch et al. |
| 8,689,471 | B2 | 4/2014 | Carpenter et al. |
| 9,015,967 | B2 | 4/2015 | May |
| 2008/0000111 | A1 | 1/2008 | Green |
| 2008/0047170 | A1 | 2/2008 | Nichols |
| 2016/0010312 | A1* | 1/2016 | Kurihara ..... E02F 3/435 701/36 |
| 2017/0073923 | A1 | 3/2017 | Aoki et al. |
| 2017/0284070 | A1 | 10/2017 | Matsuyama et al. |

FOREIGN PATENT DOCUMENTS

| | | | |
|---|---|---|---|
| EP | 3235960 | A1 | 10/2017 |
| JP | 2013127187 | A | 6/2013 |
| WO | 2017047695 | A1 | 3/2017 |

OTHER PUBLICATIONS

International Search Report and Written Opinion issued by the European Patent Office as International Searching Authority for International Application No. PCT/US2019/062455 dated Mar. 29, 2019 (14 total pages).

* cited by examiner

EXCAVATOR IMPLEMENT TEETH GRADING OFFSET DETERMINATION

BACKGROUND

The present disclosure relates to excavators which, for the purposes of defining and describing the scope of the present application, comprise an excavator boom and an excavator stick subject to swing and curl, and an excavating implement that is subject to swing and curl control with the aid of the excavator boom and excavator stick, or other similar components for executing swing and curl movement. For example, and not by way of limitation, many types of excavators comprise a hydraulically or pneumatically or electrically controlled excavating implement that can be manipulated by controlling the swing and curl functions of an excavating linkage assembly of the excavator. Excavator technology is, for example, well represented by the disclosures of U.S. Pat. No. 8,689,471, which is assigned to Caterpillar Trimble Control Technologies LLC and discloses methodology for sensor-based automatic control of an excavator, US 2008/0047170, which is assigned to Caterpillar Trimble Control Technologies LLC and discloses an excavator 3D laser system and radio positioning guidance system configured to guide a cutting edge of an excavator bucket with high vertical accuracy, and US 2008/0000111, which is assigned to Caterpillar Trimble Control Technologies LLC and discloses methodology for an excavator control system to determine an orientation of an excavator sitting on a sloped site.

BRIEF SUMMARY

According to the subject matter of the present disclosure, an excavator comprising a machine chassis, an excavating linkage assembly, an excavating implement, and control architecture. The excavating linkage assembly comprises an excavator boom and an excavator stick. The excavating linkage assembly is configured to swing with, or relative to, the machine chassis. The excavator stick is mechanically coupled to the excavator boom and is configured to curl relative to the excavator boom. The excavating implement is mechanically coupled to a terminal point of the excavator stick and is configured to curl relative to the excavator stick. The excavator boom, the excavator stick, and the excavating implement collectively define a variable implement angle $\theta_{Bucket}(t)$ that is indicative of a current position of the excavating implement relative to horizontal as a function of time t. The excavating implement comprises a plurality of implement teeth extending a tooth height h from an internal leading edge $J_I$ of the excavating implement to an external leading edge $J_E$ of the excavating implement. The plurality of implement teeth are spaced along the internal leading edge $J_I$ and define an active raking ratio r. The control architecture comprises one or more linkage assembly actuators and one or more architecture controllers programmed to execute an implement teeth grading offset determination process. The implement teeth grading offset determination process comprises determining a variable implement offset angle $\theta_{Delta}(t)$ at least partially based on a difference between an original target design angle $\theta_{Tgt}(t)$ and the variable implement angle $\theta_{Bucket}(t)$, the original target design angle $\theta_{Tgt}(t)$ indicative of a target implement slope relative to horizontal as a function of time t, determining an implement offset IO based on the tooth height h, the active raking ratio r, and the variable implement offset angle $\theta_{Delta}(t)$, and determining a new target design elevation $Elv_{Tgt,New}(t)$ based on the implement offset IO and an original target design elevation $Elv_{Tgt,Orig}(t)$. The one or more architecture controllers are further programmed to operate the excavator to grade a terrain using the plurality of implement teeth at least partially based on the new target design elevation $Elv_{Tgt,New}(t)$.

Although the concepts of the present disclosure are described herein with primary reference to the excavator illustrated in FIG. 1, it is contemplated that the concepts will enjoy applicability to any type of excavator or construction machine type, regardless of its particular mechanical configuration. For example, and not by way of limitation, the concepts may enjoy applicability to a backhoe loader including a backhoe linkage.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

The present disclosure relates to earthmoving machines and, more particularly, to earthmoving machines such as excavators including components subject to control. For example, and not by way of limitation, many types of excavators typically have a hydraulically controlled earthmoving implement that can be manipulated by a joystick or other means in an operator control station of the machine, and is also subject to partially or fully automated control. The user of the machine may control the lift, tilt, angle, and pitch of the implement. In addition, one or more of these variables may also be subject to partially or fully automated control based on information sensed or received by a dynamic sensor of the machine.

In the embodiments described herein, an excavator 100 includes control architecture that includes one or more linkage assembly actuators and one or more architecture controllers programmed to execute an implement teeth grading offset determination process. As described in greater detail further below, the implement teeth grading offset determination process may be executed to determine a new target design elevation $Elv_{Tgt,New}(t)$ as a grading setting when a plurality of implement teeth 130 are closer to a terrain than a rear implement point Q of an excavating implement 114 such that the plurality of implement teeth 130 are configured to be used for grading the terrain. However, when the plurality of implement teeth 130 are farther from the terrain than the rear implement point Q such that a rear implement edge is configured to be used for grading the terrain, an original target design elevation $Elv_{Tgt,Orig}(t)$ may be utilized as a grading setting.

Figure 1:
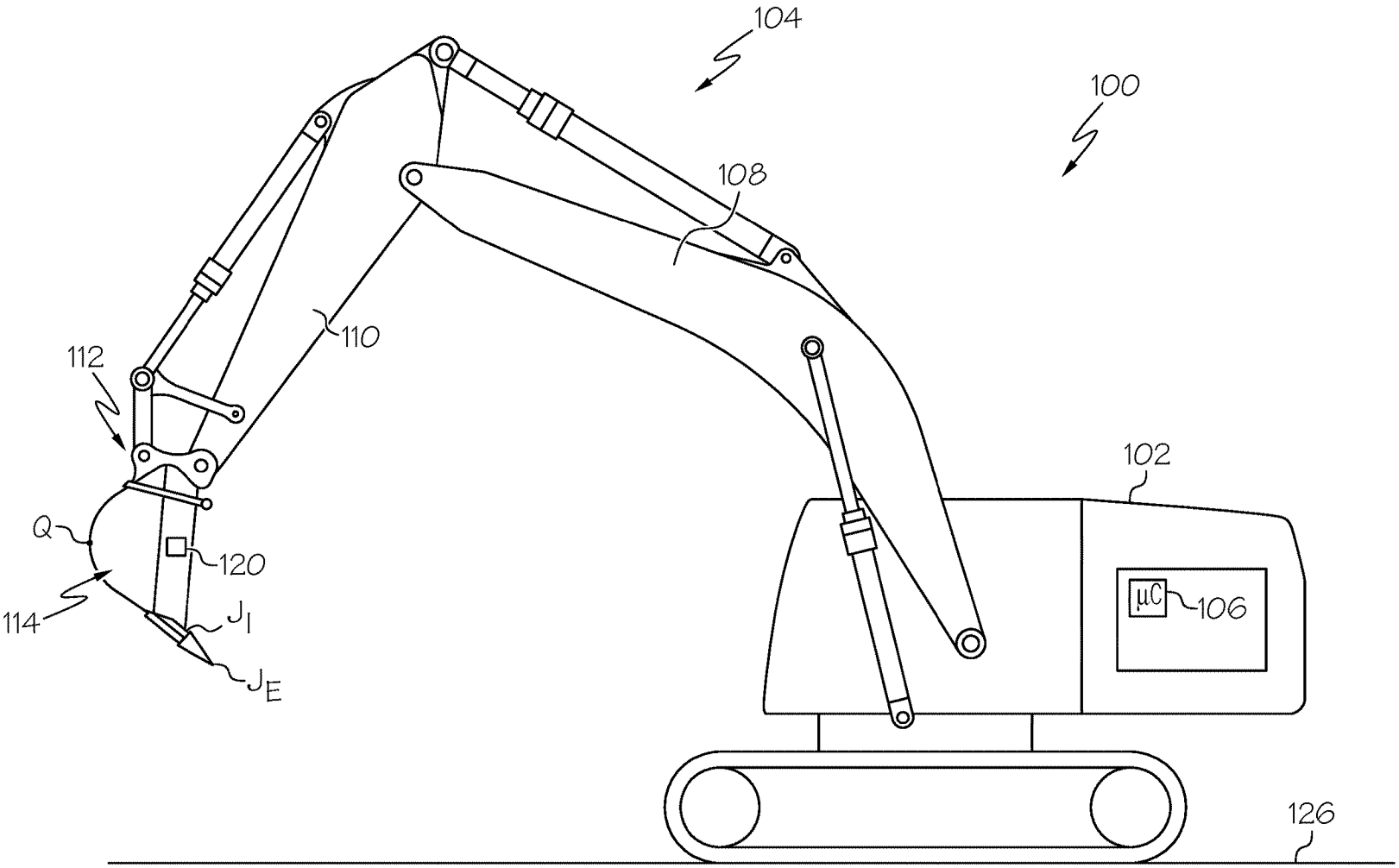
FIG. 1 is a side view of an excavator incorporating aspects of the present disclosure.

Referring initially to FIG. 1, an excavator 100 includes a machine chassis 102, an excavating linkage assembly 104, an excavating implement 114, and control architecture 106. The excavating linkage assembly 104 is configured to move or swing with, or relative to, the machine chassis 102. The excavating linkage assembly 104 includes an excavator boom 108 and an excavator stick 110. The excavating implement 114 is mechanically coupled to a terminal point of the excavator stick 110 and is configured to curl relative to the excavator stick 110. In embodiments, the excavating implement 114 is mechanically coupled through a coupling 112 to the terminal point of the excavator stick 110. The excavator boom 108, the excavator stick 110, and the excavating implement 114 collectively define a variable implement angle $\theta_{Bucket}(t)$ that is indicative of a current position of the excavating implement 114 relative to horizontal as a function of time t.

Referring to FIGS. 1, 3, and 4-5, the excavating implement 114 comprises a plurality of implement teeth 130 extending a tooth height h from an internal leading edge $J_I$ of the excavating implement to an external leading edge $J_E$ of the excavating implement 114. The implement teeth are spaced along the internal leading edge $J_I$ and define an active raking ratio r. The active raking ratio r is representative of a portion of the area between the internal leading edge $J_I$ of the excavating implement and the external leading edge $J_E$ of the excavating implement that is occupied by the collective surfaces of implement teeth 130. For example, an active raking ratio of 1.0 indicates that equal portions of the area between the internal leading edge $J_I$ of the excavating implement 114 and the external leading edge $J_E$ of the excavating implement 114 are occupied by the implement teeth 130 and spaces 132 between the implement teeth. Higher active raking ratios may represent wider and/or more narrowly spaced teeth, while lower active raking ratios may represent narrower and/or more widely spaced teeth.

Figure 2:
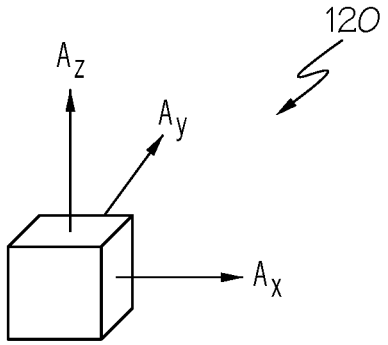
FIG. 2 is a perspective view of a dynamic sensor disposed on a linkage of the excavator of FIG. 1 and according to various concepts of the present disclosure.

In embodiments, the implement dynamic sensor 120 comprises an inertial measurement unit (IMU), an inclinometer, an accelerometer, a gyroscope, an angular rate sensor, a rotary position sensor, a position sensing cylinder, or combinations thereof. The IMU may include a 3-axis accelerometer and a 3-axis gyroscope. As shown in FIG. 2, the implement dynamic sensor 120 includes accelerations $A_x$, $A_y$, and $A_z$, respectively representing x-axis, y-axis-, and z-axis acceleration values.

The control architecture 106 includes one or more linkage assembly actuators and one or more architecture controllers programmed to execute an implement teeth grading offset determination process. In embodiments, the control architecture comprises a non-transitory computer-readable storage medium comprising machine readable instructions that the one or more architecture controllers are programmed to execute. The one or more linkage assembly actuators may facilitate movement of the excavating linkage assembly 104. Further, the one or more linkage assembly actuators may comprise a hydraulic cylinder actuator, a pneumatic cylinder actuator, an electrical actuator, a mechanical actuator, or combinations thereof.

Figure 5:
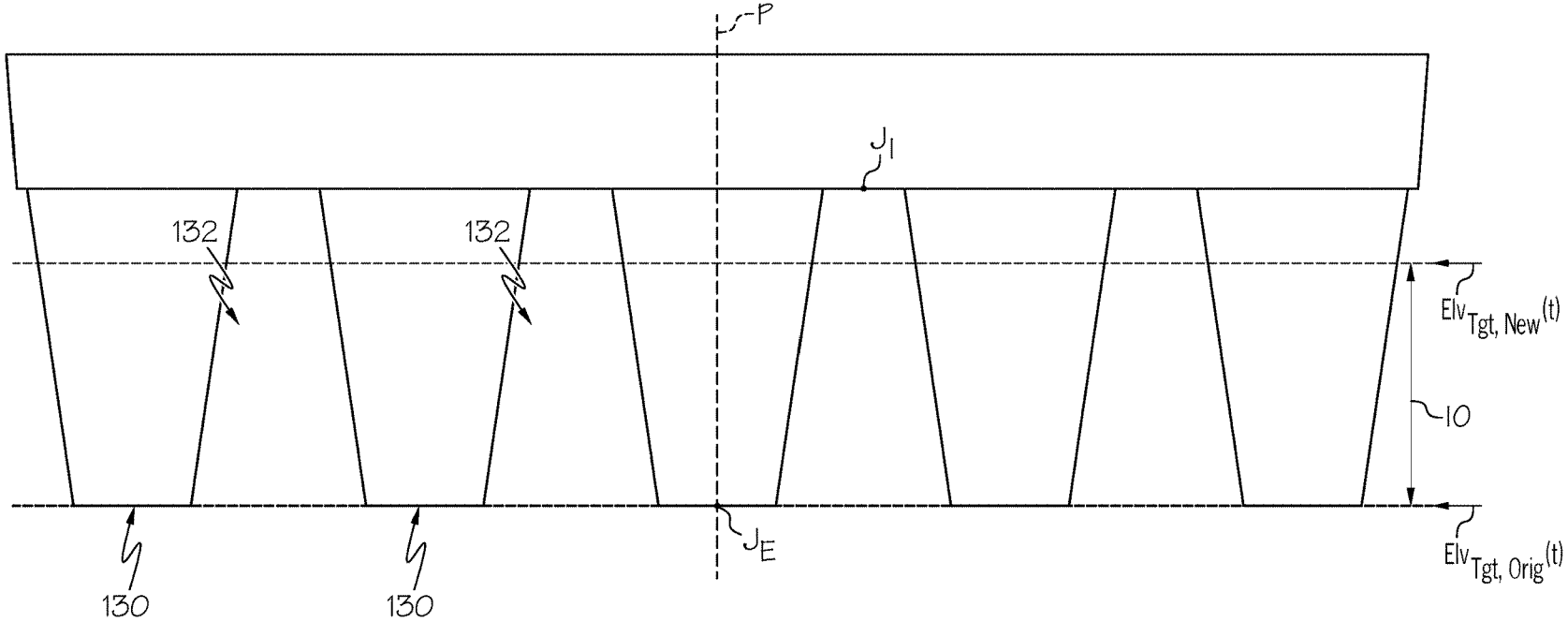
FIG. 5 is another side elevation view of an alternative plurality of teeth of the excavating implement of the excavator of FIG. 1, according to various concepts of the present disclosure.
Figure 6:
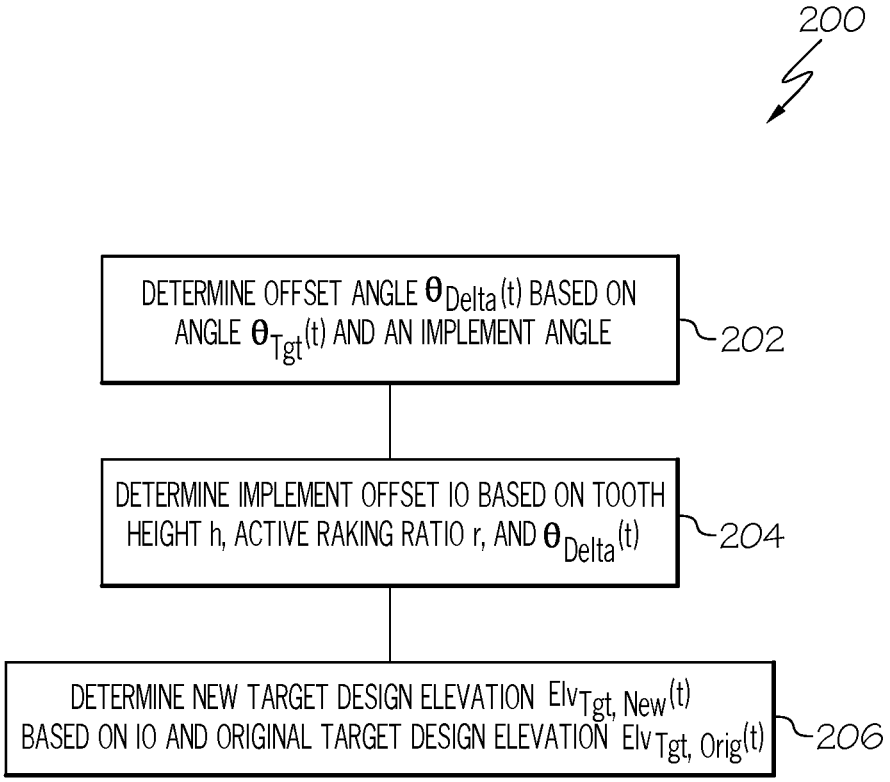
FIG. 6 is a flow chart of a process used to determine an implement teeth grading offset for use by the excavator of FIG. 1.

The implement teeth grading offset determination process is illustrated in FIG. 6 through a control scheme 200 and steps 202-206. The implement teeth grading offset determination process includes determining in step 202 a variable implement offset angle $\theta_{Delta}(t)$ at least partially based on a difference between an original target design angle $\theta_{Tgt}(t)$ and the variable implement angle $\theta_{Bucket}(t)$. The original target design angle $\theta_{Tgt}(t)$ is indicative of a target implement slope relative to horizontal as a function of time t. Further, an implement offset IO (FIG. 5) is determined in step 204 based on the tooth height h, the active raking ratio r, and the variable implement offset angle $\theta_{Delta}(t)$. In step 206, a new target design elevation $Elv_{Tgt,New}(t)$ is determined based on the implement offset 10 and the original target design elevation $Elv_{Tgt,Orig}(t)$.

The one or more architecture controller are further programmed to operate the excavator 100 to grade a terrain, such as of a ground 126, using the plurality of implement teeth 130 at least partially based on the new target design elevation $Elv_{Tgt,New}(t)$. In embodiments, the excavating implement 114 includes a rear implement point Q. The one or more architecture controllers are programmed to execute the implement teeth grading offset determination process when the excavating implement 114 is curled to bring the plurality of implement teeth 130 closer to the terrain than the rear implement point Q such that the plurality of implement teeth 130 are configured to be used for grading the terrain, such as the ground 126. The one or more architecture controllers are further programmed to return to the original target design elevation $Elv_{Tgt,Orig}(t)$ as a grading setting when the excavating implement 114 is curled to bring the rear implement point Q closer to the terrain than the plurality of implement teeth 130 such that the rear implement point Q is configured to be used for grading the terrain, such as the ground 126.

Figure 3:
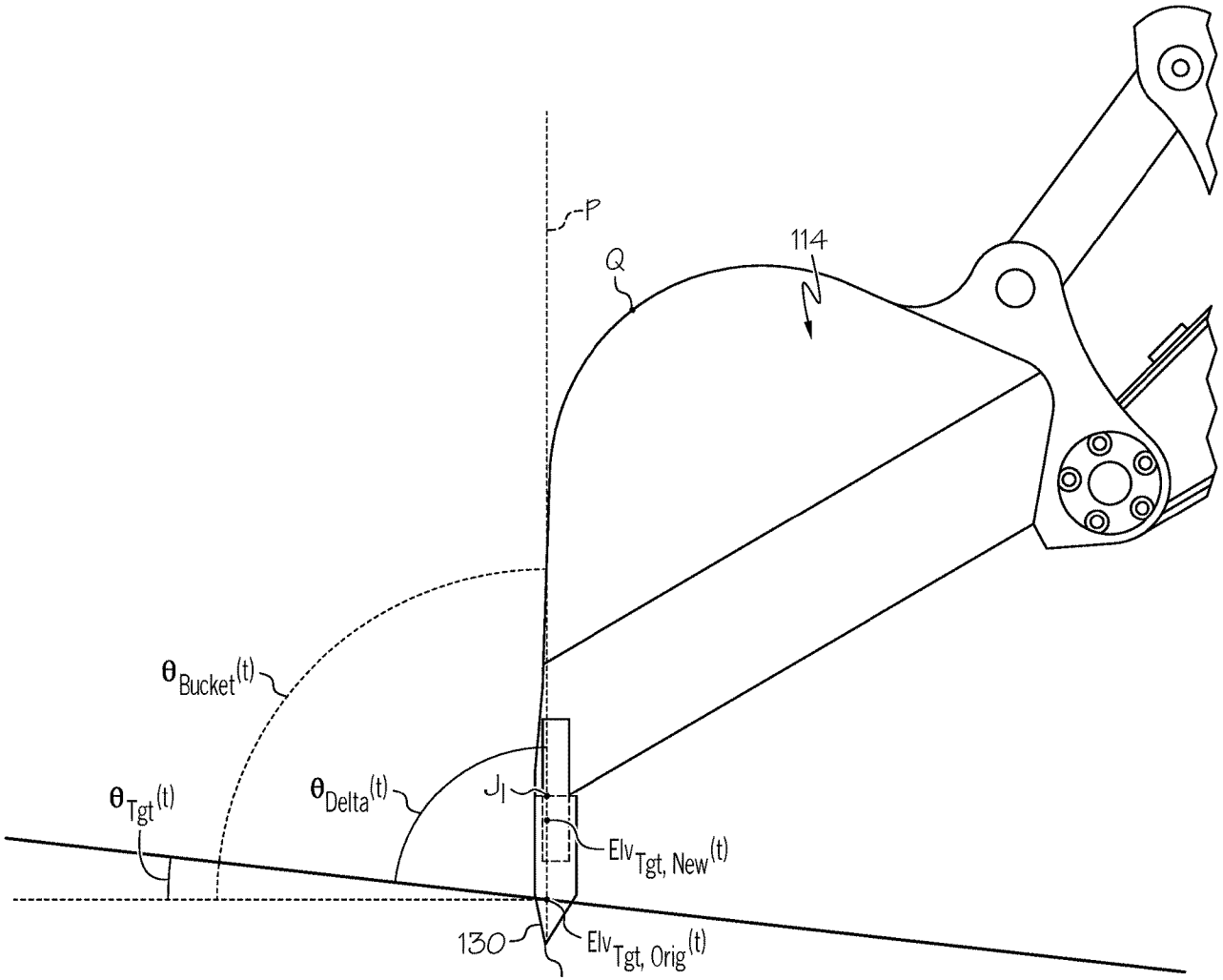
FIG. 3 is a side elevation view of an excavating implement of the excavator of FIG. 1 in a tooth grading position, according to various concepts of the present disclosure.
Figure 4:
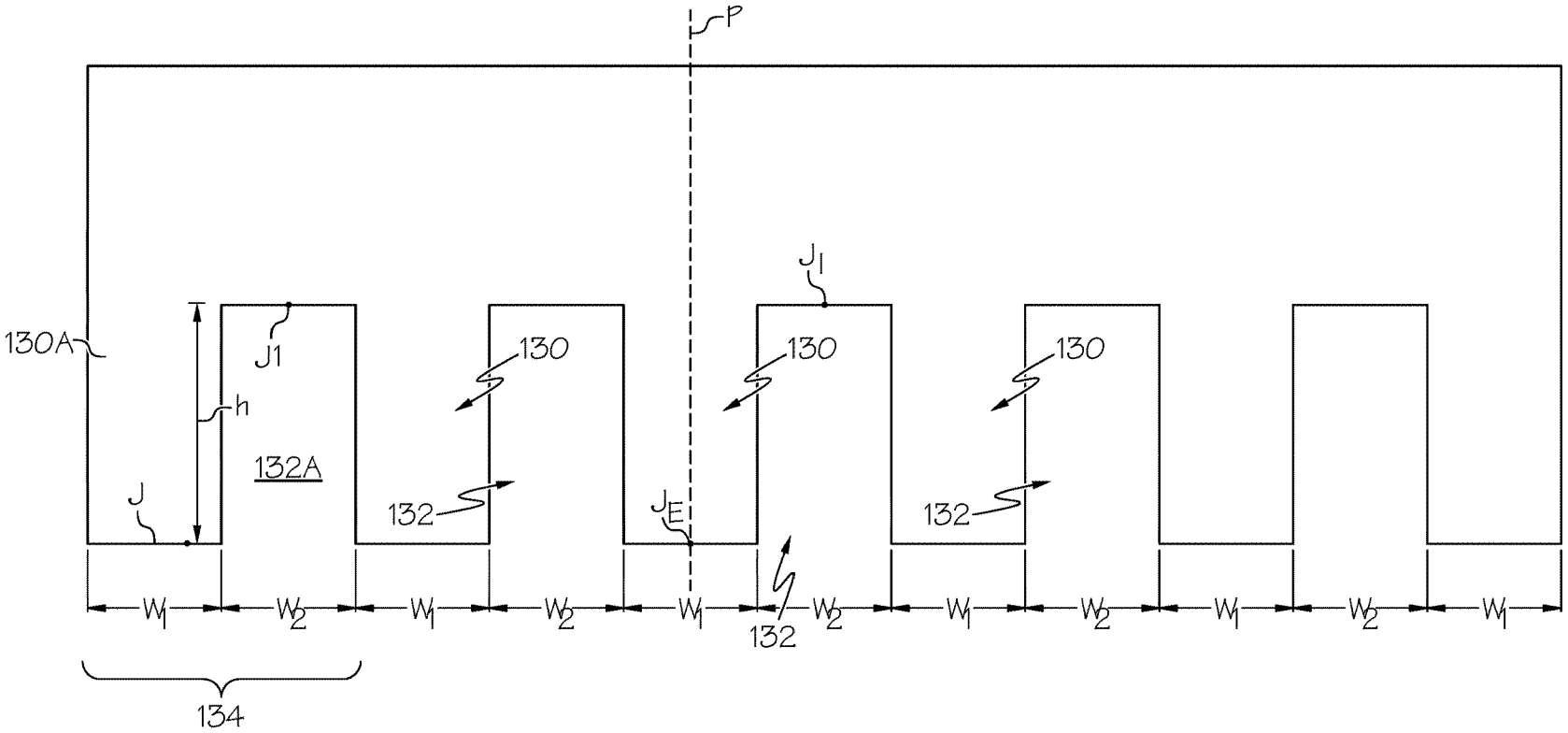
FIG. 4 is a side elevation view of a plurality of teeth of the excavating implement of the excavator of FIG. 1, according to various concepts of the present disclosure.

Referring to FIGS. 3-5, a tooth axis P intersects a bottom edge point of the excavating implement 114 and a coaxially aligned point on a tooth 130A of the plurality of implement teeth 130 at the external leading edge $J_E$ of the excavating implement 114. The variable implement angle $\theta_{Bucket}(t)$ is indicative of the current position of the excavating implement 114 relative to horizontal and with respect to the tooth axis P. Further, the original target design angle $\theta_{Tgt}(t)$ is indicative of the target implement slope relative to horizontal and with respect to the tooth axis P.

In embodiments, the plurality of implement teeth 130 include uniform teeth heights. Alternatively, the plurality of implement teeth 130 include variable teeth heights such that the tooth height h may defined by an average of the variable teeth heights or may defined by a common tooth height. The common tooth height is defined by a majority height of the plurality of implement teeth 130.

Referring to FIG. 4, the plurality of implement teeth 130 may include straight edge teeth. Each tooth 130A may include a tooth width $w_1$, and each space 132A between the plurality of implement teeth 130 may include comprises an air space width $w_2$. The active raking ratio r may be defined by a following equation:

$$r = \frac{5w_2}{6w_1}$$

In an embodiment in which there are X number of teeth and Y number of air spaces between the teeth, the active ratio r may be defined by a following equation:

$$r = \frac{Yw_2}{Xw_1}$$

Alternatively, referring to FIG. 5, the plurality of implement teeth 130 may include one or more angled teeth, one or more non-uniform shaped teeth, or combinations thereof. The active raking ratio r may then at least be partially based on an average width of the plurality of implement teeth 130 and an average width of spaces 132 between the plurality of implement teeth 130.

In embodiments, the implement offset is determined based on a following equation:

$$h*r*\sin\theta_{Delta}(t)$$

Further, the new target design elevation $Elv_{Tgt,New}(t)$ is defined by a following equation:

$$Elv_{Tgt,New}(t)=Elv_{Tgt,Orig}(t)+h*r*\sin\theta_{Delta}(t)$$

The variable implement offset angle $\theta_{Delta}(t)$ may be in a range of from about 0 degrees to about 180 degrees. However, when the variable implement offset angle $\theta_{Delta}(t)$ is outside a range of from about 0 degrees to about 180 degrees, $\sin\theta_{Delta}(t)$ may be set to zero. This setting may avoid a negative implement offset TO, for example. In embodiments, the implement offset IO is in a range that is a function of teeth height and/or length. As a non-limiting example, the teeth length may be longer than 10 inches. As an example and not a limitation, in embodiments, the implement offset IO is in a range of from about 0.5 inches to about 3 inches.

It is contemplated that the embodiments of the present disclosure may assist to permit a speedy and more cost efficient method of determining grade plane signals and/or offsets in a manner that minimizes a risk of human error with such value determinations. Further, the controller of the excavator or other control technologies are improved such that the processing systems are improved and optimized with respect to speed, efficiency, and output.

A signal may be "generated" by direct or indirect calculation or measurement, with or without the aid of a sensor For the purposes of describing and defining the present invention, it is noted that reference herein to a variable being a "function" of a parameter or another variable is not intended to denote that the variable is exclusively a function of the listed parameter or variable. Rather, reference herein to a variable that is a "function" of a listed parameter is intended to be open ended such that the variable may be a function of a single parameter or a plurality of parameters.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

For the purposes of describing and defining the present invention it is noted that the terms "substantially" and "approximately" and "about" are utilized herein to represent the inherent degree of uncertainty that may be attributed to any quantitative comparison, value, measurement, or other representation. The terms "substantially" and "approximately" and "about" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. An excavator comprising a machine chassis, an excavating linkage assembly, an excavating implement, and control architecture, wherein:

the excavating linkage assembly comprises an excavator boom and an excavator stick;

the excavating linkage assembly is configured to swing with, or relative to, the machine chassis;

the excavator stick is mechanically coupled to the excavator boom and is configured to curl relative to the excavator boom;

the excavating implement is mechanically coupled to a terminal point of the excavator stick and is configured to curl relative to the excavator stick;

the excavator boom, the excavator stick, and the excavating implement collectively define a variable implement angle $\theta_{Bucket}(t)$ that is indicative of a current position of the excavating implement relative to horizontal as a function of time t;

the excavating implement comprises a plurality of implement teeth extending a tooth height h from an internal leading edge $J_I$ of the excavating implement to an external leading edge $J_E$ of the excavating implement;

the plurality of implement teeth are spaced along the internal leading edge $J_I$ and define an active raking ratio r;

the control architecture comprises one or more linkage assembly actuators and one or more architecture controllers programmed to execute an implement teeth grading offset determination process, the implement teeth grading offset determination process comprising determining a variable implement offset angle $\theta_{Delta}(t)$ at least partially based on a difference between an original target design angle $\theta_{Tgt}(t)$ and the variable implement angle $\theta_{Bucket}(t)$, the original target design angle $\theta_{Tgt}(t)$ indicative of a target implement slope relative to horizontal as a function of time t, determining an implement offset IO based on the tooth height h, the active raking ratio r, and the variable implement offset angle $\theta_{Delta}(t)$, and determining a new target design elevation $Elv_{Tgt,New}(t)$ based on the implement offset IO and an original target design elevation $Elv_{Tgt,Orig}(t)$; and the one or more architecture controllers are further programmed to operate the excavator to grade a terrain using the plurality of implement teeth at least partially based on the new target design elevation $Elv_{Tgt,New}(t)$.

2. The excavator of claim 1, wherein a tooth axis P intersects a bottom edge point of the excavating implement and a coaxially aligned point on a tooth of the plurality of implement teeth at the external leading edge $J_E$ of the excavating implement.

3. The excavator of claim 2, wherein the variable implement angle $\theta_{Bucket}(t)$ is indicative of the current position of the excavating implement relative to horizontal and with respect to the tooth axis P.

4. The excavator of claim 2, wherein the original target design angle $\theta_{Tgt}(t)$ is indicative of the target implement slope relative to horizontal and with respect to the tooth axis P.

5. The excavator of claim 1, wherein the excavating implement comprises a rear implement point Q.

6. The excavator of claim 5, wherein the one or more architecture controllers are programmed to execute the implement teeth grading offset determination process when the excavating implement is curled to bring the plurality of implement teeth closer to the terrain than the rear implement point Q such that the plurality of implement teeth are configured to be used for grading the terrain.

7. The excavator of claim 5, wherein the one or more architecture controllers are further programmed to return to the original target design elevation $Elv_{Tgt,Orig}(t)$ as a grading setting when the excavating implement is curled to bring the rear implement point Q closer to the terrain than the plurality of implement teeth such that the rear implement point Q is configured to be used for grading the terrain.

8. The excavator of claim 7, wherein the one or more architecture controllers are further programmed to execute the implement teeth grading offset determination process when the excavating implement is curled to bring the plurality of implement teeth closer to the terrain than the rear implement point Q such that the plurality of implement teeth are configured to be used for grading the terrain.

9. The excavator of claim 1, wherein the plurality of implement teeth include uniform teeth heights.

10. The excavator of claim 1, wherein the plurality of implement teeth include variable teeth heights.

11. The excavator of claim 10, wherein the tooth height h is defined by an average of the variable teeth heights.

12. The excavator of claim 10, wherein the tooth height h is defined by a common tooth height, and the common tooth height is defined by a majority height of the plurality of implement teeth.

13. The excavator of claim 1, wherein the plurality of implement teeth comprise straight edge teeth.

14. The excavator of claim 13, for X number of teeth and Y number of spaces, wherein each tooth comprises a tooth width $w_1$, each space between the plurality of implement teeth comprises an air space width $w_2$, and the active raking ratio r comprises:

$$r = \frac{Yw_2}{Xw_1}$$

15. The excavator of claim 1, wherein the plurality of implement teeth comprise one or more angled teeth, one or more non-uniform shaped teeth, or combinations thereof.

16. The excavator of claim 15, wherein the active raking ratio r is at least partially based on an average width of the plurality of implement teeth and an average width of spaces between the plurality of implement teeth.

17. The excavator of claim 1, wherein the implement offset TO comprises a following equation:

$$h*r*\sin\theta_{Delta}(t)$$

18. The excavator of claim 1, wherein the new target design elevation $Elv_{Tgt,New}(t)$ is defined by a following equation:

$$Elv_{Tgt,New}(t)=Elv_{Tgt,Orig}(t)+h*r*\sin\theta_{Delta}(t)$$

19. The excavator of claim 18, wherein the variable implement offset angle $\theta_{Delta}(t)$ is in a range of from about 0 degrees to about 180 degrees.

20. The excavator of claim 18, wherein when the variable implement offset angle $\theta_{Delta}(t)$ is outside a range of from about 0 degrees to about 180 degrees, $\sin\theta_{Delta}(t)$ is set to zero.

* * * * *